US005941272A

United States Patent [19]

Feldman

[11] Patent Number: 5,941,272

[45] Date of Patent: Aug. 24, 1999

[54] THREE WAY UNIVERSAL VALVE

[75] Inventor: Robert M. Feldman, Newton, Mass.

[73] Assignee: Imaginair, Inc., Wauconda, Ill.

[21] Appl. No.: 08/767,106

[22] Filed: Dec. 4, 1996

[51] Int. Cl.[6] ..... A47C 27/08; F16K 15/20

[52] U.S. Cl. ..... 137/223; 5/706; 251/213; 251/284; 251/287

[58] Field of Search ..... 137/223, 230, 137/226; 251/213, 284, 286, 287; 152/427, 429, 431; 5/706

[56] References Cited

U.S. PATENT DOCUMENTS

| | | | |
|---|---|---|---|
| 1,819,872 | 8/1931 | Cooke et al. | 152/429 |
| 2,778,374 | 1/1957 | Boyer | 152/429 |
| 2,855,946 | 10/1958 | Mackal | 137/223 |
| 3,465,780 | 9/1969 | Duymelinck et al. | 152/429 |
| 3,489,167 | 1/1970 | Kilmarx et al. | 152/429 |
| 3,536,117 | 10/1970 | Huber | 137/223 |
| 3,637,002 | 1/1972 | Hughes | 152/429 |
| 3,722,569 | 3/1973 | Hughes | 152/429 |
| 3,786,994 | 1/1974 | Kukes et al. | 137/223 |
| 4,073,389 | 2/1978 | Angarola et al. | 137/223 |
| 4,579,141 | 4/1986 | Arff | 137/223 |
| 4,765,358 | 8/1988 | Cady | 137/223 |
| 4,948,092 | 8/1990 | Kasper et al. | 137/223 |
| 4,977,633 | 12/1990 | Chaffee | 5/706 |
| 5,111,838 | 5/1992 | Langston | 137/223 |
| 5,203,831 | 4/1993 | Lind et al. | 137/223 |
| 5,267,363 | 12/1993 | Chaffee | 5/710 |
| 5,295,504 | 3/1994 | Riquier et al. | 137/230 |
| 5,367,726 | 11/1994 | Chaffee | 5/706 |
| 5,398,744 | 3/1995 | Street | 137/230 |

*Primary Examiner*—George L. Walton

*Attorney, Agent, or Firm*—Mason, Kolehmainen, Rathburn & Wyss

[57] ABSTRACT

A valve assembly for inflatable bladders, including beds, balls, toys, and other inflatable objects includes a locking mechanism within the valve for releasably holding the valve opened. The valve acts in three distinct ways. In a first way the valve is closed maintaining the bladder internal pressure. In a second way the valve may be incrementally opened by a user to release the internal pressure to suit the user. In a third way the valve may be opened and locked or latched to remain open allowing the deflation of the bladder. A spring provides a return force to close the valve when the lock is not engaged. Air pressure from outside the bladder supplied by a pump or the like will force the valve diaphragm open against the spring and allow air to enter. The diaphragm is made of a resilient seal material. The locking mechanism is engaged by pressing the diaphragm open and twisting to engage a lock. When the lock is further twisted or twisted in the reverse direction the lock is disengaged allowing the spring and internal air pressure to close the valve. The valve can be pressed from the exterior to open the valve, without engaging the lock, for a selectable time such that the pressure within the bladder can be adjusted. Adapters may be used with the valve assembly so that different air blowers can be used to inflate the bladder.

18 Claims, 2 Drawing Sheets

THREE WAY UNIVERSAL VALVE

FIELD OF THE INVENTION

The present invention relates generally to the field of inflatable systems and apparatus, and more particularly to the valve assembly used for inflating and deflating pneumatic bladders.

BACKGROUND OF THE INVENTION

Air beds with pneumatic bladders where the user controls pressures for comfort are known. These devices are described in several U.S. patents: U.S. Pat. No. 4,977,633 which issued on Dec. 18, 1990; U.S. Pat. No. 5,267,363 which issued on Dec. 7, 1993, and U.S. Pat. No. 5,367,726 which issued on Nov. 29, 1994, all to Robert Chaffee. These three patents are hereby incorporated by reference herein as if laid out in full.

The above inventions include a valve assembly with motorized inflater attached such that the attaching of the motor activates the inflation without needing an activating switch. The inflation is fast and will continue until the motorized inflator is removed. The inflator is designed with a large volume of air flow but at a small pressure differential across the impeller. In this case when the air pressure in the bladder may only be about one pound per square inch (1 psi) the inflator cannot push more air into the bladder. A larger valve is incorporated into the valve assembly for deflation. In some embodiments, deflation is achieved by removing the motorized inflator and opening the entire valve assembly via a hinge for quick deflation. A limitation of these devices is the requirement that the hinged opening for deflation involves a second sealing surface. There is a concern since each sealing surface is susceptible to leaking—fewer sealing surfaces are preferred.

Further limitations of these prior art systems, due to the two sealing surfaces, is that the valves are larger, have more parts, are more expensive, are more complex, and are less reliable.

In the prior art there is disclosed a electrically activated (via a switch in a 120 VAC power line), plug-in, motorized inflator that is attached to a valve in an air bed. The activating switch may be constructed and arranged with a pressure relief mechanism incorporated into the valve. The user can incrementally increase or decrease the pressure by activating the switch or the relief mechanism, respectively, to suit the comfort of the user.

It is an object of the present invention to provide one valve that performs three functions. A first function allows fast automatic inflation; a second function provides comfort control; and the third functions allows fast deflation.

It is an object of the present invention to provide a single sealing surface while still providing the above three functions.

It is yet another object of the present invention to provide means for comfort control by incrementally opening the valve to release pressure very slowly or more quickly depending upon what is desired.

It is another object of the present invention to provide a releasable locking system for bladder deflation.

It is another object of the present invention to provide a reliable valve assembly with an adapter set that allows inflation from a variety of sources having different nozzle sizes, e.g. the Aero® pump, vacuum cleaners, hair dryers, and the like.

SUMMARY OF THE INVENTION

The above objects are met in a valve assembly for controlling the inflation and deflation of an inflatable bladder or other inflatable device defining an interior and an exterior. The valve is disposed between the interior and the exterior and includes: a housing with a through passageway from the exterior and the interior, an attaching surface for attaching the valve to the bladder is provided that surrounds the housing, means for substantially hermetically sealing said attaching surface to the bladder, a sealing surface or lip extending into said passageway, said interior side of the sealing surface defining a valve seat, diaphragm means constructed to mate with said valve seat defining closed and open positions, and when closed thereby sealing said interior from said exterior preventing fluid exchange therebetween, and when opened thereby allowing fluid communication between said interior and said exterior, support and guide means attached to said housing, said support and guide means capturing and supporting said diaphragm means and guiding said diaphragm means to engage said valve seat around the entire periphery of said valve seat when closed, means for forcing said diaphragm means against said valve seat, and releasable means for holding said diaphragm in said open position.

In a preferred embodiment the attaching surface is a flange that is sealed to the device material and in another preferred embodiment the attaching surface is a threaded surface that engaged a mating threaded surface built into the device. The device in a preferred embodiment is a flexible bladder.

In another preferred embodiment the passageway and the valve seat and diaphragm means are circular, the diaphragm is flexible, and there is access from the exterior side such that an external force may be applied that opens the diaphragm means, and means are provided to hold the valve open when the external force is removed. On the interior side of the housing a shelf is provided, and a stem is attached to and extends from about the center of the diaphragm means past the shelf. A protuberance radially extending from the stem is positioned to engage the shelf when the stem is rotated. The spring force holds the protuberance against the shelf until the stem is rotated back or forward such that the protuberance is no longer aligned with the shelf whereupon the spring forces the stem and the diaphragm means back to the closed position. The shelf can have a hump or anti-rotation means that requires the stem to be pushed farther against the spring such that the protuberance can clear the hump when rotated—then releasing the pressure will cause the valve to close.

Another preferred embodiment includes an axially slotted tube with a circumferential slot to accept the protuberance and hold the valve opened. The slot extends axially along the tube. At a position along the axial slot a second circumferential slot intersects the axial slot, this second slot is constructed partially around the circumference of the tube cross section. The protuberance engages this second slot when the diaphragm is rotated thereby rotating the protuberance. There is a spring load, in a preferred embodiment, that retains the diaphragm open by retaining the protuberance in the second slot by friction. In another preferred embodiment there is an anti-rotation hump in the second slot that prevents the diaphragm means from reentering the axial slot without further pushing against the spring means. This type of locking mechanism is referred to as a bayonet lock. In another preferred embodiment there is a second axial slot to which the protuberance can be positioned for closing the diaphragm means by rotating in the same direction as when first engaging the holding circumferential slot.

In another preferred embodiment the exterior side of the diaphragm has an extension that is accessible from the exterior. Pressing inwardly against a spring force on this extension forces the diaphragm opened. Releasing this pressing allows the diaphragm means to close. In this manner the user can incrementally open the valve to control the interior pressure to suit the user. If desired, the user can lock the valve opened to quickly deflate the device.

An advantage of the present invention, referred to before, is that there is only one sealing surface whereby the bladder can be inflated, deflated in a controlled fashion or totally deflated in a reasonably quick time. The single sealing surface provides, inherently, better sealing reliability while being less expensive, smaller, and using fewer mechanical parts.

In another preferred embodiment there is an adapter set that allows a variety of different sized nozzles to inflate the bladder.

Other objects, features and advantages will be apparent from the following detailed description of preferred embodiments thereof taken in conjunction with the accompanying drawings in which:

DETAILED DESCRIPTION OF PREFERRED EMBODIMENTS

Figure 1:
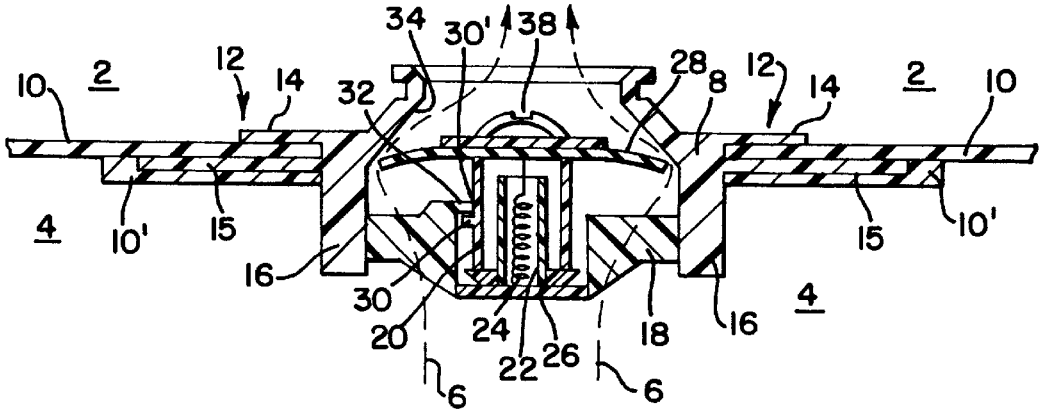
FIG. 1 is a pictorial detail of a preferred embodiment of the valve assembly mechanism in the opened state.
Figure 2:
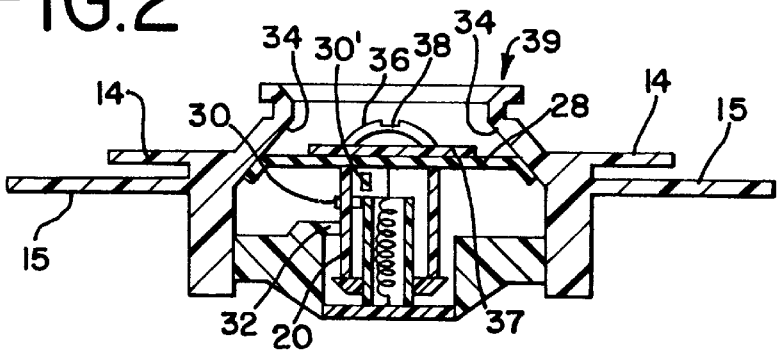
FIG. 2 is a pictorial detail of FIG. 1, but in a closed state.

FIG. 1 shows the inventive valve in cross section installed in an inflatable bladder or other such pneumatic device. The valve is shown in a cylindrical form in an open latched state that allows air 6 an escape path from the interior 4 to the exterior 2. There is a housing 8 that is hermetically sealed and attached to the flexible bladder 10 at the locations 12. The housing material is a PVC material that is known in the art. There are double flange 14 and 15 that encircle the valve housing. The bladder material 10 is fit into the crevice between the flanges and another piece of the bladder material 10' surrounds the flange 15. There is a seal at location 12 made by known methods via heat sealing or mechanical sealing with a clip or combination thereof which attaches the flanges 14 and 15 to the material 10 and 10'. The housing extends 16 into the interior of the inflatable device. A framework of preferably PVC 18 is attached to the housing extension 16 and provides a holding and guiding mechanism for the stem 20. There is a coaxial tube 22 within the stem 20, and there is a spring 24 coiled in the tube 22. The spring is anchored to the bottom 26 of the framework 18. The other end of the spring is attached to a diaphragm assembly 28. The spring is in compression so that it is trying to elongate itself and force the diaphragm 28 farther away from the bottom 26. The spring works to urge the valve closed as shown in FIG. 2. However, in FIG. 1, there are two protuberances 30 and 30' that extend radially from the stem 20. These protuberances 30 and 30' engage a shelf 32 that is formed as part of the framework 18. As shown in FIG. 1 the valve is opened and locked open by the engagement of the protuberances 30, 30' and the shelf 32. In this position, there is a space between the end of the diaphragm 28 and the sloped wall 34. There are apertures in the framework that physically allows air 6 pass through the valve.

FIG. 2 shows the valve in a closed position. The stem 20 has been twisted such that the protuberances 30 and 30' do not engage the shelf 32. The spring drives the stem 20 upward forcing the diaphragm 28 to engage the wall 34 and form a seal that prevents air from escaping. The spring and any air pressure within the bladder act to maintain the seal.

Still referring to FIG. 2 there is a top location button 36 that is physically accessible from the exterior. A human finger may be inserted touching and manipulating the tactile surface of 36. The air pressure and the spring force are in the order of a few ounces or so and is easily overcome by pressing the button 36 inward. By this pressing the stem 20 is depressed forcing the seal between the diaphragm 28 and the wall 34 to be broken and allowing air to escape from the bladder. There is a retaining washer 37 under the button 36 and on top of the seal material 26. By intermittently depressing location button 36 to release air the air pressure in the bladder and so the firmness of the bladder may be lowered for comfort control. If the bladder is the mattress of an air bed, the comfort of a human lying on the bed can be accommodated by this adjusting of the firmness.

Still referring to FIG. 2, location 36 is constructed with a tactile or somewhat adhering or "sticky" surface. A human finger pressing with a light (say a few ounces) can depress and rotate the stem by rotating the finger. In other preferred embodiments a slot 38 suitable for a screw driver may be formed to allow rotation. Other small extensions or protuberances may be formed at the upper surface of the location button 36 to accommodate rotation of the stem.

The protuberance 30 is in a channel that allows the stem to clear or engage the shelf 22. The protuberance 30' acts as a stop, as discussed below. The human can depress the stem against the spring and any internal air pressure in the bladder, and rotate the stem to lock and retain the valve open by aligning the protuberance and the shelf. The dimensions of the valve and the seal 24 can run from quite small, substantially less than an inch wide, to quite large, many inches wide, to accommodate a wide variety of bladders. If the valve is less than an inch wide a pencil, small screw driver or other thin object may be needed to depress location button 36. In such an instance, a slot 38 may be formed in location button 36 to allow rotation and thereby to allow the air to escape deflating the bladder in a few minutes depending on the size of the bladder.

Figure 3:
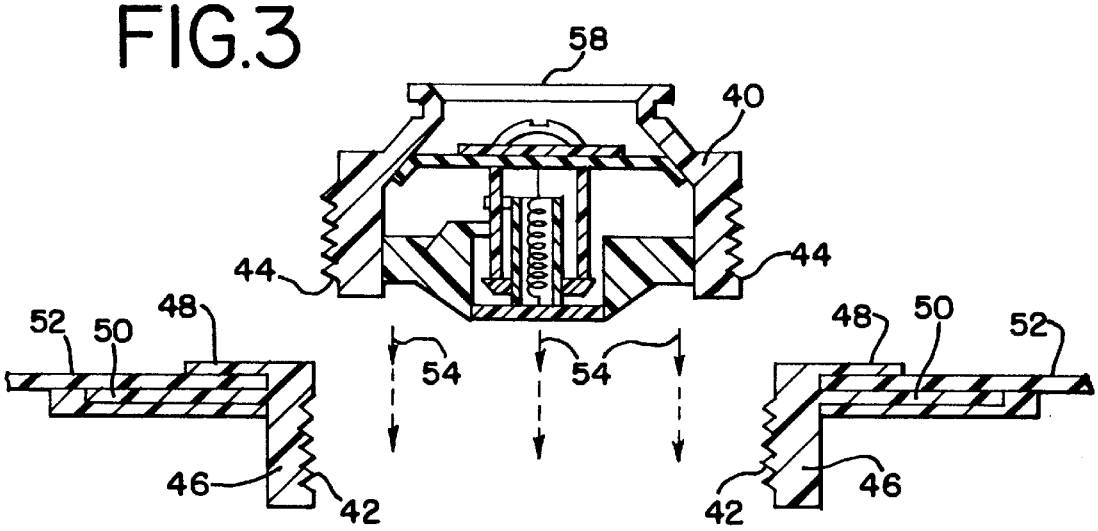
FIG. 3 is a cross section of another preferred embodiment.

FIG. 3 shows the inventive valve with a screw thread 44 formed into the housing 40. In this instance, the bladder has a matching receptacle 46 in cross section with dual flanges 48 and 50. The flanges are attached by known means to the bladder 52. The receptacle has a screw thread 42 that matches the thread 44 on the valve. The valve moves into 54 and screws into the receptacle. The matching threads are constructed and arranged to form an air tight seal by methods known in the art.

Figure 4:
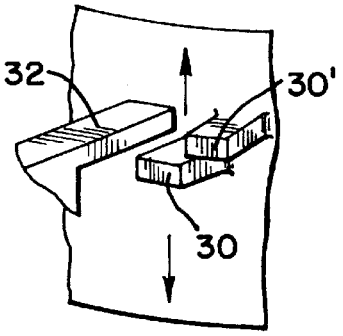
FIG. 4 is a top view of a preferred embodiment of the valve.
Figure 5:
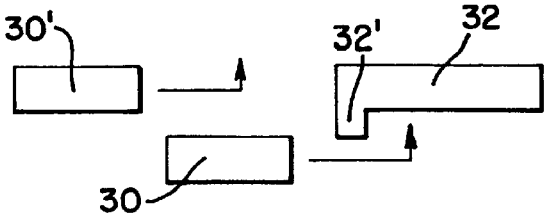
FIGS. 5, 6, and 7 show in detail a preferred locking mechanism.
Figure 6:
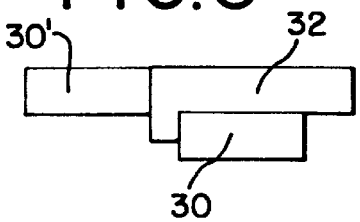

FIGS. 4, 5, and 6 show the detail interaction of the shelf 32 and the protuberances 30 and 30' described above. In FIG. 4 the shelf 32 is not aligned vertically with the protuberances 30 and 30'. In this position the protuberances are free to move vertically as indicated by the arrows. In this position the valve allows filling of the bladder when there is an external air pressure that is greater than the spring force and the internal air pressure of the bladder. If there is no filling air pressure the spring and the internal air pressure in the bladder will force the valve closed, as discussed regarding FIG. 2, maintaining the air pressure in the bladder. Additionally, as discussed above, location button 36 of FIG. 2 can be depressed opening the bladder incrementally to reduce, as desired, the air pressure in the bladder.

FIG. 5, a cross section through the shelf 32 and the protuberances 30 and 30' shows the relative interaction of these elements. FIG. 5 has these elements in the same relative position as in FIG. 4 where the protuberances 30 and 30' can move vertically relative to each other. However, the arrows indicate how the rotation of the stem allows the protuberances to engage the shelf 32 to prevent the vertical motion that would close the valve. The protuberances 30 and 30' can be rotated under the shelf as indicated by the arrows in FIG. 5. The protuberances have been depressed and rotated under the shelf 32 to align the shelf 32 and the protuberance 30. Protuberance 30' forms a stop such that the rotation is limited. The height of the protuberance 30' is constructed to engage the side of the shelf to prevent the protuberance 30 from passing to the other side of the shelf 32. FIG. 6 shows the relative position when the valve is locked open allowing deflation. There is a small lip 32' extending from the shelf 32 that acts as a bayonet lock to retain the elements in the position of FIG. 6. In this state the valve is locked open to allow deflation with no further interaction with the valve. In another preferred embodiment the stop 30' may be deleted.

In order to inflate the bladder in a normal fashion location button 36 of FIG. 1 must be depressed so that protuberance 30 clears the lip 32', then location button 36 must be rotated to where the protuberance 30 clears the shelf 32 vertically allowing the spring to close the valve. The bladder can be inflated with the valve locked opened, however, when complete the stem must be rotated back to the relative position of FIG. 5 to allow the spring and the internal air pressure to close the valve and retain air pressure in the bladder.

Figure 7:
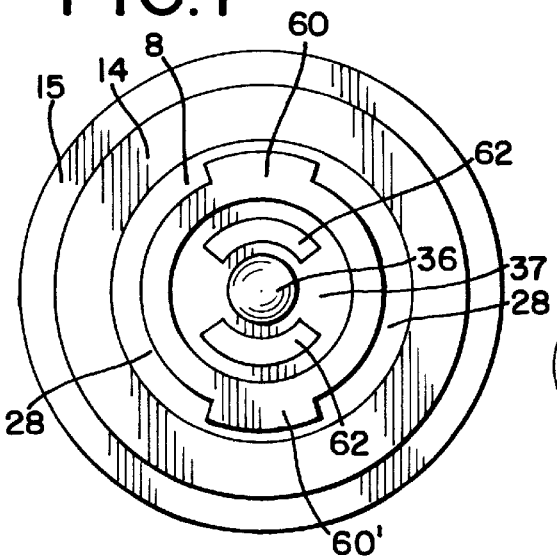
Figure 8D:
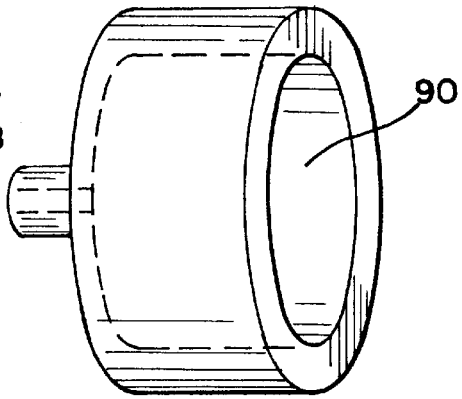
FIGS. 8A, 8B, 8C, and 8D show an assembly of adapters.
Figure 8A:
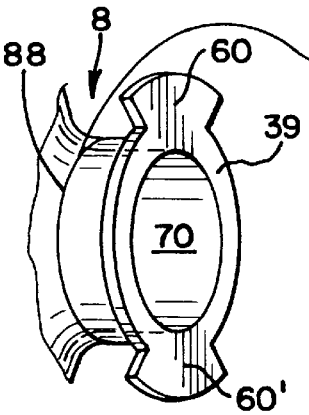

FIG. 7 is a top view of the valve of FIGS. 1 and 2. Location button 36 is shown in the center and the flexible seal 28 is shown with the retaining washer 37. There are air passages 62 through the washer 37. The flanges 14 and 15 are shown at the periphery. The housing 8 has a top rim 39 on FIG. 2 with two ears 60 and 60' that extend outward from this top rim. FIG. 8A shows this top rim in a pictorial view.

Figure 8B:
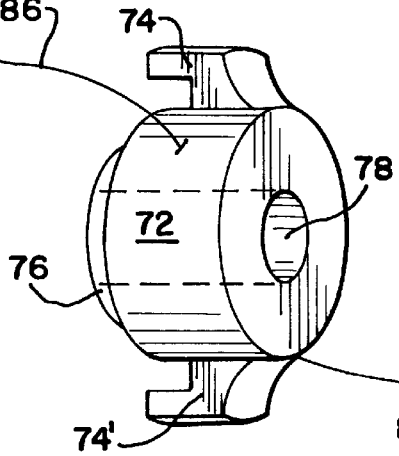
Figure 8C:
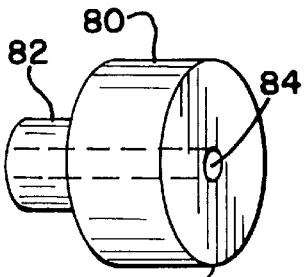

FIGS. 8A, B, and C show a set of adapters that accommodate a variety of inflation nozzles. FIG. 8A shows the ears 60 and 60'. There is an opening 70 into which the nozzle of an inflator fits allowing inflation of the bladder. However, other possible inflation sources exist that may have nozzles that do not fit the opening 70. FIG. 8B shows an adapter 72 with extensions 74 and 74' that engage the ears 60 and 60' to hold the adapter 72 to the valve housing 8. As shown, the adapter must be rotated 90 degrees and inserted over the rim 39 with the extension 74 and 74' clearing the ears 60 and 60'. The barrel 76 is constructed to fit interferingly with the opening 70. The adapter is then rotated back the 90 degrees to engage the extensions 74, 74' and the ears 60, 60' to retain the adapter to the valve. The through hole 78 is smaller than the opening 70 to accommodate other nozzle sizes. FIG. 8C shows another adapter 80 with a tubular extension 82 that interferingly fits into the opening 78 of adapter 72. This fit is a friction only fit, but interlocking or bayonet locking may be used to advantage. There is a through hole 84 in adapter 80 that is smaller yet than hole 78 to accommodate even smaller nozzles. A tether 86 may be provided to keep the adapters together, and the tether may be formed into a ring 88 that is fit around the neck of the valve so that the valve and the adapters are always together. It should be noted that the adapter could provide a larger opening. For example, the through hole 84 could have different sized openings on each end of the hole. FIG. 8D shows such an adapter where there the adapter allows a larger nozzle opening 90 to adapt to a smaller opening 78. In such cases the air pressure alone from the inflator is used to open the valve against the spring, but other physical extensions (not shown) from the nozzles could be used, or alternatively the valve could be locked open and then closed immediately after inflation.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A valve assembly for inflating and deflating a bladder having a bladder wall for separating an interior and an exterior of said bladder, said valve assembly comprising:

a valve housing disposed in an opening of said wall, said valve housing having a fluid passageway for providing fluid communication between said interior and said exterior of said bladder and having an outer attaching surface for hermetically sealing said valve housing to said bladder wall;

a lip disposed in said passageway providing a valve seat;

a stem disposed in said passageway, said stem being movable within said passageway with respect to said valve seat;

a resilient sealing means mounted on said stem within said passageway, said stem being movable to a closed position whereby said sealing means is in contact with said valve seat thereby closing said fluid communication through said passageway and to a open position whereby said sealing means in displaced from said valve seat thereby opening said fluid communication through said passageway;

a support means extending into said passageway, said support means comprising a frame extending in said housing across said passageway;

a biasing member associated with said sealing means for urging said sealing means against said valve seat, said biasing member being a spring with a first end attached to said frame and a second end attached to said sealing means;

a first locking means on said stem; and a second locking means extending into said passageway and selectively engageable with said first locking means, said stem being maintained in said open position against the urgence of said biasing member and said sealing means is maintained displaced from said valve seat when said first and second locking means are engaged.

2. A valve assembly for inflating and deflating a bladder having a bladder wall for separating an interior and an exterior of said bladder, said valve assembly comprising:

a valve housing disposed in an opening of said wall, said valve housing having a fluid passageway for providing fluid communication between said interior and said exterior of said bladder and having an outer attaching surface for hermetically sealing said valve housing to said bladder wall;

a lip disposed in said passageway providing a valve seat;

a stem disposed in said passageway, said stem being movable within said passageway with respect to said valve seat;

a resilient sealing means mounted on said stem within said passageway, said sealing means being a generally flexible circular diaphragm with an outer annular region engaging said valve seat when said stem is in said closed position and said stem extending axially in said passageway along said valve seat towards said interior and is movable to a closed position whereby said sealing means is in contact with said valve seat thereby closing said fluid communication through said passageway and to a open position whereby said sealing means in displaced from said valve seat thereby opening said fluid communication through said passageway;

a biasing member associated with said sealing means for urging said sealing means against said valve seat;

a first locking means on said stem, said first locking means including a radial protuberance projecting from said stem; and a second locking means extending into said passageway and selectively engageable with said first locking means, said second locking means being an extension extending into said passageway to form a shelf for releasably mating with said protuberance when said first and second locking means are engaged to hold said stem in said open position against the urgence of said biasing member and said sealing means displaced from said valve seat such that said outer annular region of said diaphragm does not contact said valve seat when said protuberance mates with said shelf, and permitting said biasing member to urge said stem toward said closed position such that said outer annular region of said diaphragm contacts said valve seat when said protuberance is released from mating with said shelf.

3. A valve assembly as in claim 2 further comprising an activating means associated with an exterior side of said sealing means for moving said sealing means from said exterior such that by pressing said activating means forces said stem toward said interior and to said open position, by rotating said activating means said protuberance and said shelf mate with each other to hold said stem to said open position, and by further rotating of said activating means unmates said protuberance from said shelf to permit said stem to return to said closed position.

4. A valve assembly as in claim 3 wherein said pressing said activating means toward said interior incrementally displaces said diaphragm incrementally from said valve seat and wherein said diaphragm is in contact with said valve seat to close the fluid communication between said interior and said exterior when said activating means is not being pressed.

5. A valve assembly for inflating and deflating a bladder having a bladder wall for separating an interior and an exterior of said bladder, said valve assembly comprising:

a valve housing disposed in an opening of said wall, said valve housing having a fluid passageway for providing fluid communication between said interior and said exterior of said bladder and having an outer attaching surface for hermetically sealing said valve housing to said bladder wall;

a lip disposed in said passageway providing a valve seat;

a stem disposed in said passageway, said stem being movable within said passageway with respect to said valve seat;

a resilient sealing means mounted on said stem within said passageway, said stem being movable to a closed position whereby said sealing means is in contact with said valve seat thereby closing said fluid communication through said passageway and to a open position whereby said sealing means in displaced from said valve seat thereby opening said fluid communication through said passageway;

a biasing member associated with said sealing means for urging said sealing means against said valve seat;

a first locking means on said stem; and a second locking means extending into said passageway and selectively engageable with said first locking means, said stem being maintained in said open position against the urging of said biasing member and said sealing means is maintained displaced from said valve seat when said first and second locking means are engaged.

6. A valve assembly as in claim 1 wherein said sealing means comprises a resilient diaphragm the outer periphery of which engages said valve seat when said stem is in said closed position.

7. A valve assembly as in claim 1 further comprising:

an aperture within said passageway providing access to said stem from said exterior;

activating means associated with said stem for activating said stem through said aperture from said exterior to move said stem and thereby said sealing means toward said open position.

8. A valve assembly for inflating and deflating a bladder having a bladder wall for separating an interior and an exterior of said bladder, said valve assembly comprising:

a valve housing disposed in an opening of said wall, said valve housing having a fluid passageway for providing fluid communication between said interior and said exterior of said bladder and having an outer housing wall from which extends a first flange thereabout and a second flange thereabout, said first and second flanges being spaced apart from each other to form a crevice, a portion of said bladder wall being disposed in said crevice and an integral portion of said bladder wall being wrapped about an end of said second flange and against an interior side of said second flange so that said bladder wall is hermetically sealed to said outer housing wall; and a valve means within said passageway to control the flow of fluid through said passageway between said exterior and said interior.

9. A valve assembly as in claim 8 including sealing means to seal said bladder wall in said crevice.

10. A valve assembly as in claim 8 wherein said flanges extending from said housing outer wall are formed integrally with said housing outer wall.

11. A valve assembly for inflating with pumps having nozzles of different sizes and deflating a bladder having a bladder wall for separating an interior and an exterior of said bladder, said valve assembly comprising:

a valve housing disposed in an opening of said bladder wall, said valve housing having an exterior end extending out from said exterior of said bladder and an interior end extending into said interior of said bladder and having a fluid passageway extending to said exterior end from said interior end of said housing for providing fluid communication between said interior and said exterior of said bladder, said passageway at said exterior end having an exterior aperture through which said passageway is in fluid communication with said exterior of said bladder;

a valve means within said passageway to control the flow of fluid through said passageway between said exterior end and said interior end;

a separate selectable first inflator adapter for different sized pump nozzles adapted to be detachably mounted to said exterior end of said housing, said first inflator adapter having a first aperture of smaller size than said exterior aperture and in fluid communication with said exterior aperture; and a separate selectable second inflator adapter for different sized pump nozzles adapted to be detachably mounted to said first inflator adapter and having a second aperture of smaller size than said first aperture and in fluid communication with said first aperture.

12. A valve assembly as in claim 11 including first mounting means extending about said exterior aperture and second mounting means extending from said first inflator adapter, said first and second mounting means matable with each other to maintain said first inflator adapter mounted on said exterior end of said housing relative to said exterior aperture.

13. A valve assembly as in claim 11 wherein said second inflator adapter has first and second openings of different sizes, said second opening being of a smaller size than said first opening and wherein said first opening extends from said first aperture in said first inflator adapter.

14. A valve assembly for inflating and deflating a bladder having a bladder wall for separating an interior and an exterior of said bladder, said valve assembly comprising:

a valve housing disposed in an opening of said wall, said valve housing having a fluid passageway for providing fluid communication between said interior and said exterior of said bladder and having an outer attaching surface for hermetically sealing said valve housing to said bladder wall;

a lip disposed in said passageway providing a valve seat;

a stem disposed in said passageway, said stem being movable within said passageway with respect to said valve seat;

a resilient sealing means mounted on said stem within said passageway, said stem being movable to a closed position whereby said sealing means is in contact with said valve seat thereby closing said fluid communication through said passageway and to an open position whereby said sealing means in displaced from said valve seat thereby opening said fluid communication through said passageway;

a biasing member associated with said sealing means for urging said sealing means against said valve seat;

a first locking member on said stem; and a second locking member extending into said passageway, said first locking member being selectively engageable with said second locking member such that said stem is maintained in a fixed position and said sealing means is maintained fixed with respect to said valve seat when said first and second locking members are engaged notwithstanding said urging of said biasing member.

15. A valve assembly as in claim 14 further comprising:

an aperture within said passageway providing access to said stem from said exterior; and activating means associated with said stem for activating said stem through said aperture from said exterior to move said stem and thereby said sealing means toward said open position.

16. A valve assembly as in claim 14 wherein said sealing means is a generally flexible circular diaphragm with an outer annular region engaging said valve seat when said stem is in said closed position;

wherein said stem extends axially in said passageway along said seating means towards said interior;

wherein said first locking member includes a radial protuberance projecting from said stem; and wherein said second locking member is a shelf extending into said passageway for releasably mating with said protuberance to maintain said stem in said fixed position.

17. A valve assembly as in claim 16 further comprising an activating means associated with an exterior side of said sealing means for moving said sealing means from said exterior such that by pressing said activating means said stem is moved towards said interior and to said open position and by rotating said activating means said protuberance and said shelf mate with each other to hold said stem in said fixed position.

18. A valve assembly as in claim 17 wherein said pressing said activating means toward said interior incrementally displaces said sealing means incrementally from said valve seat and wherein said sealing means is in contact with said valve seat to close the fluid communication between said interior and said exterior when said activating means is not being pressed.

* * * * *